US011215936B2

(12) United States Patent
Suzuki et al.

(10) Patent No.: US 11,215,936 B2
(45) Date of Patent: Jan. 4, 2022

(54) TONER, IMAGE FORMING APPARATUS, IMAGE FORMING METHOD, AND TONER ACCOMMODATING UNIT

(71) Applicant: RICOH COMPANY, LTD., Tokyo (JP)

(72) Inventors: Namie Suzuki, Shizuoka (JP); Yoshitaka Yamauchi, Shizuoka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/695,273

(22) Filed: Nov. 26, 2019

(65) Prior Publication Data

US 2020/0174391 A1 Jun. 4, 2020

(30) Foreign Application Priority Data

Nov. 29, 2018 (JP) ..... JP2018-224056

(51) Int. Cl.

| | |
|---|---|
| ***G03G 9/08*** | (2006.01) |
| ***G03G 9/097*** | (2006.01) |
| ***G03G 9/087*** | (2006.01) |
| ***G03G 15/20*** | (2006.01) |

(52) U.S. Cl.

CPC ..... *G03G 9/09775* (2013.01); *G03G 9/0821* (2013.01); *G03G 9/08755* (2013.01); *G03G 9/08782* (2013.01); *G03G 15/20* (2013.01)

(58) Field of Classification Search

CPC ..... G03G 9/0821; G03G 9/08782; G03G 9/09775

See application file for complete search history.

(56) References Cited

U.S. PATENT DOCUMENTS

| | | | | |
|---|---|---|---|---|
| 8,673,528 | B2 * | 3/2014 | Sugimoto | G03G 9/0806 430/108.2 |
| 2010/0143834 | A1 * | 6/2010 | Ayaki | G03G 9/08708 430/109.3 |
| 2013/0330522 | A1 | 12/2013 | Suzuki et al. | |
| 2014/0080047 | A1 | 3/2014 | Takahashi et al. | |
| 2014/0080050 | A1 | 3/2014 | Asahina et al. | |
| 2014/0272690 | A1 | 9/2014 | Suzuki et al. | |
| 2014/0342286 | A1 | 11/2014 | Yamauchi et al. | |
| 2015/0030819 | A1 | 1/2015 | Naito et al. | |
| 2015/0037718 | A1 | 2/2015 | Morita et al. | |

(Continued)

FOREIGN PATENT DOCUMENTS

| | | |
|---|---|---|
| JP | 8-234478 | 9/1996 |
| JP | 2006-113473 | 4/2006 |

(Continued)

OTHER PUBLICATIONS

Chemical Abstracts Registry No. 109-23-9. (Year: 2020).*

*Primary Examiner* — Mark A Chapman
(74) *Attorney, Agent, or Firm* — Grüneberg and Myers PLLC

(57) ABSTRACT

A toner is provided. The toner comprises a binder resin, a release agent, and a function imparting agent comprising a fatty acid amide having a melting point of from 110 to 160 degrees C. When the toner is heated by a differential scanning calorimeter, the toner exhibits no endothermic peak within a temperature range of ±20 degrees C. of a temperature at a highest endothermic peak derived from the fatty acid amide.

10 Claims, 3 Drawing Sheets

(56) References Cited

U.S. PATENT DOCUMENTS

| | | | | |
|---|---|---|---|---|
| 2015/0153671 | A1 | 6/2015 | Yamauchi et al. | |
| 2015/0212444 | A1 | 7/2015 | Yamauchi et al. | |
| 2015/0220011 | A1 | 8/2015 | Miyaake et al. | |
| 2015/0248074 | A1 | 9/2015 | Suzuki et al. | |
| 2015/0253685 | A1 | 9/2015 | Suzuki et al. | |
| 2015/0253688 | A1 | 9/2015 | Yamauchi et al. | |
| 2015/0284532 | A1* | 10/2015 | Burlett ..... | C08L 91/06<br>428/36.9 |
| 2016/0327884 | A1 | 11/2016 | Nakajima et al. | |
| 2017/0139337 | A1 | 5/2017 | Kaneko et al. | |
| 2018/0067409 | A1 | 3/2018 | Yamauchi et al. | |
| 2018/0113391 | A1 | 4/2018 | Yamauchi et al. | |
| 2018/0259864 | A1 | 9/2018 | Suzuki et al. | |
| 2018/0267418 | A1 | 9/2018 | Ogino et al. | |
| 2019/0278191 | A1 | 9/2019 | Suzuki et al. | |

FOREIGN PATENT DOCUMENTS

| | | | |
|---|---|---|---|
| JP | 2010-266548 | | 11/2010 |
| WO | WO2004/055600 | A1 | 7/2004 |

* cited by examiner

TONER, IMAGE FORMING APPARATUS, IMAGE FORMING METHOD, AND TONER ACCOMMODATING UNIT

CROSS-REFERENCE TO RELATED APPLICATIONS

This patent application is based on and claims priority pursuant to 35 U.S.C. § 119(a) to Japanese Patent Application No. 2018-224056, filed on Nov. 29, 2018, in the Japan Patent Office, the entire disclosure of which is hereby incorporated by reference herein.

BACKGROUND

Technical Field

The present disclosure relates to a toner, an image forming apparatus, an image forming method, and a toner accommodating unit.

Description of the Related Art

In recent years, a heating roller method has been widely used for its energy efficiency as a fixing method in electrophotography. In the heating roller method, a heating roller is directly pressed against a toner image on a recording medium to be fixed thereon. The heating roller method requires a large amount of electric power in fixing the toner image. Therefore, there have been attempts to reduce electric power consumption by the heating roller to save energy.

For example, one general method involves reducing the output of a heater for the heating roller during absence of image output and increasing the output of the heater to raise the temperature of the heating roller during image output. In this case, however, it takes several tens of seconds of waiting time to raise the temperature of the heating roller to the temperature necessary for fixing from that in the sleep time. By completely turning off the output of the heater for the heating roller during absence of image output, the electric power consumption can be further reduced.

To meet such requirement, it is effective to lower the fixing temperature of toner itself, to lower the temperature of the heating roller necessary for fixing the toner, to reduce the electric power consumption during fixing. In view of this, toner with excellent low-temperature fixability has been being developed. However, if the fixing temperature of toner itself is lowered, storage stability and blocking resistance of the toner are degraded. It is difficult for the toner to achieve all these properties at the same time.

In attempting to provide a toner having excellent low-temperature fixability and storage stability, a toner containing a crystalline polyester dispersed in an amorphous polyester has been proposed that utilizes the sharply-melting property of the crystalline polyester.

As another example, there has been an attempt to improve low-temperature fixability of toner by controlling thermal properties of the binder resin of toner by making the toner to contain a saturated fatty acid amide having specific properties or an amide wax having a specific structure, as a fixing auxiliary component, together with the binder resin.

There has been another attempt to provide a two-component developer having high durability that hardly causes toner spent and carrier deterioration, by adding at least one specific wax selected from synthetic wax, ester wax, fatty acid amide wax, and fatty acid ester wax to the toner to improve offset resistance of the toner and coating the carrier surface with a resin composition.

Thus, to improve low-temperature fixability, it has been necessary to lower thermal properties of the binder resin itself. It has been difficult for toner to achieve storage stability, durability, and blocking resistance at the same time.

SUMMARY

In accordance with some embodiments of the present invention, a toner is provided. The toner comprises a binder resin, a release agent, and a function imparting agent comprising a fatty acid amide having a melting point of from 110 to 160 degrees C. When the toner is heated by a differential scanning calorimeter, the toner exhibits no endothermic peak within a temperature range of ±20 degrees C. of a temperature at a highest endothermic peak derived from the fatty acid amide.

In accordance with some embodiments of the present invention, an image forming apparatus is provided. The image forming apparatus includes: an electrostatic latent image bearer; an electrostatic latent image forming device configured to form an electrostatic latent image on the electrostatic latent image bearer; a developing device accommodating the above-described toner, configured to develop the electrostatic latent image formed on the electrostatic latent image bearer with the toner to form a toner image; a transfer device configured to transfer the toner image formed on the electrostatic latent image bearer onto a surface of a recording medium; and a fixing device configured to fix the toner image on the surface of the recording medium.

In accordance with some embodiments of the present invention, an image forming method is provided. The image forming method includes the processes of: forming an electrostatic latent image on an electrostatic latent image bearer; developing the electrostatic latent image formed on the electrostatic latent image bearer with the above-described toner; transferring the toner image formed on the electrostatic latent image bearer onto a surface of a recording medium; and fixing the toner image on the surface of the recording medium.

In accordance with some embodiments of the present invention, a toner accommodating unit is provided. The toner accommodating unit includes a container and the above-described toner.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
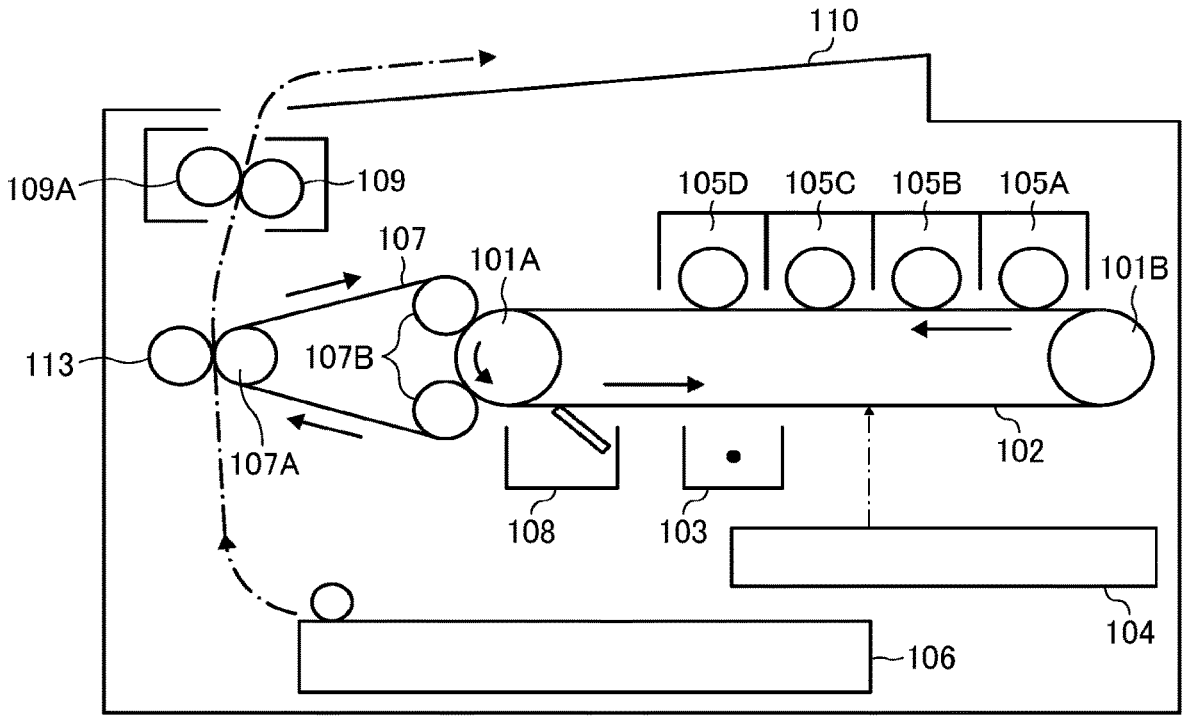
FIG. 1 is a schematic view of an image forming apparatus according to an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

In accordance with some embodiments of the present invention, a toner having excellent low-temperature fixability, blocking resistance, and durability is provided.

A toner according to an embodiment of the present invention comprises a binder resin, a release agent, and a function imparting agent. The function imparting agent comprises a fatty acid amide having a melting point of from 110 to 160 degrees C. When the toner is heated by a differential scanning calorimeter, the toner exhibits no endothermic peak within a temperature range of ±20 degrees C. of a temperature at the highest endothermic peak derived from the fatty acid amide.

Hereinafter, a toner, a toner accommodating unit, an image forming apparatus, and an image forming method according to some embodiments of the present invention are described in detail.

Toner

The toner according to an embodiment of the present invention contains at least a binder resin, a release agent, and a function imparting agent, and further contains other components, as necessary.

Function Imparting Agent

The function imparting agent comprises a fatty acid amide having a melting point of from 110 to 160 degrees C.

The fatty acid amide has a long-chain alkyl group and a highly-polar amide group in the molecule, and they are associated by hydrogen bonds. Therefore, the fatty acid amide exhibits unique physical properties. In particular, the fatty acid amide can function as a solid compound having surface activity on the surface of a substance. Due to this property, among the release agent and the fatty acid amide deposited out from the inside of the toner that has been heated and melted by the heating roller, the fatty acid amide is present in larger amounts on the outermost surface of the fixed image as compared with the release agent. Thus, the surface of the fixed toner image is protected by the fatty acid amide having high thermophysical properties added to the toner, and blocking resistance is improved.

The fatty acid amide is not particularly limited in molecular structure as long as it has an amide bond (—CONH—) at least in the molecule or at a terminal of the molecule and has a melting point of from 110 to 160 degrees C.

Examples of the fatty acid amide include, but are not limited to, monoamides such as capramide, lauramide, palmitamide, stearamide, arachidamide, behenamide, and hydroxystearamide. Examples of the fatty acid amide further include methylol amides such as methylol stearamide and methylol behenamide. Examples of suitable fatty acid amides further include, but are not limited to, bisamides such as methylenebis stearamide, methylenebis lauramide, methylenebis hydroxystearamide, ethylenebis capramide, ethylenebis lauramide, ethylenebis stearamide, ethylenebis isostearamide, ethylenebis hydroxystearamide, ethylenebis behenamide, hexamethylenebis stearamide, hexamethylenebis behenamide, hexamethylenebis hydroxystearamide, butylenebis hydroxystearamide, N,N'-distearyl adipamide, and N,N'-distearyl sebacamide. Examples of bisamides further include methylenebis oleamide, ethylenebis oleamide, ethylenebis erucamide, hexamethylenebis oleamide, N,N'-dioleyl adipamide, N,N'-dioleyl sebacamide, m-xylylenebis stearamide, and N,N'-distearyl isophthalamide. Those having a melting point of 110 degrees C. or higher are selected from these fatty acid amides for blocking resistance.

The fatty acid amide has a melting point of from 110 to 160 degrees C. When the melting point of the fatty acid amide is less than 110 degrees C., blocking resistance is insufficient because of poor thermal properties even when the fatty acid amide is present on the surface of the fixed image. When the melting point of the fatty acid amide is higher than 160 degrees C., blocking resistance is insufficient because the fatty acid amide does not sufficiently melt inside the toner at the time when the toner gets fixed and does not exude out to the toner surface.

The toner according to an embodiment of the present invention exhibits no endothermic peak within a temperature range of ±20 degrees C. of a temperature at the highest endothermic peak derived from the fatty acid amide when the toner is heated by a differential scanning calorimeter (DSC). This indicates that the fatty acid amide has been compatibilized with the binder resin without being present as crystalline domains in the toner. In this case, since the fatty acid amide does not present as crystal domains in the toner, deterioration of durability due to destruction of crystal structure is avoided. By contrast, when the toner has an endothermic peak in a temperature range of ±20 degrees C. of a temperature at the highest endothermic peak derived from the fatty acid amide, this indicates that the fatty acid amide has not been compatibilized with the binder resin and is present as crystal domains inside the toner. In this case, the crystal domains will be destroyed by external stresses to degrade durability. Furthermore, the fatty acid amide has a property of easily depositing on the toner surface. This indicates that there is a possibility that the surface structure of the toner is affected when the crystal domains thereof are destroyed, which may cause deterioration of durability and toner filming on a photoconductor.

Such a toner which exhibits no endothermic peak within a temperature range of ±20 degrees C. of a temperature at the highest endothermic peak derived from the fatty acid amide may be produced by, for example, adjusting the compatibility between the binder resin and the fatty acid amide or the content of the fatty acid amide.

The proportion of the fatty acid amide in the toner is not limited as long as the fatty acid amide gets compatibilized with the binder resin and the toner exhibits no endothermic peak, but is preferably from 0.5 to 3.0% by mass.

When the toner containing the fatty acid amide is fixed at a fixing temperature of 160 degrees C. to obtain a toner image and the surface of the image is analyzed by TOF-SIMS (time-of-flight secondary ion mass spectrometry), the resulting mass spectrum exhibits a peak derived from the fatty acid amide. When no peak derived from the fatty acid amide is exhibited, it means that the fatty acid amide does not present in a region extending from the outermost surface of the toner to a depth of about 1 to 2 nm, which is the detection range of TOF-SIMS. In this case, the fatty acid amide exerts no effect on blocking resistance.

When the fatty acid amide is a primary amide represented by the following structural formula (1), the inside of the machine using the toner is prevented from being contaminated with the fatty acid amide.

$$R1\text{-}CO\text{—}NH_2 \qquad \text{Structural formula (1)}$$

In the structural formula (1), R1 represents a hydrocarbon group that may have an unsaturated group.

By the use of an aliphatic monoamide having an amide bond at a terminal of the molecule, represented by the structural formula (1), the amount of particles generated at the time when the toner is overheated to get fixed is reduced, as compared with the case using one having an amide bond inside the molecule. Therefore, the inside of the machine using the toner is prevented from being contaminated with the fatty acid amide.

The components contained in the toner can be structurally analyzed by pyrolysis gas chromatography mass spectrometry (pyrolysis GCMS), by which the presence/absence of acid amide, structure, melting point, etc. can be determined.

There is a tendency that fatty acid amides are more compatible with resins compared to general waxes because of having an amide bond inside the molecule and thereby easily form hydrogen bonds with resins. Moreover, in the case of using a wax dispersing agent (to be described later), the fatty acid amide can get compatibilized with the binder resin without forming domains inside the wax dispersing agent, regardless of the compatibility of the fatty acid amide with the wax dispersing agent.

Binder Resin

The binder resin, which is one of toner components, is not particularly limited and can be suitably selected to suit to a particular application. Any conventionally known resin can be used.

Examples of the binder resin include, but are not limited to, styrene-based resins (e.g., homopolymers and copolymers comprising styrene or a styrene-substituted body) such as polystyrene, poly-α-methylstyrene, styrene-chlorostyrene copolymer, styrene-propylene copolymer, styrene-butadiene copolymer, styrene-vinyl chloride copolymer, styrene-vinyl acetate copolymer, styrene-maleic acid copolymer, styrene-acrylate copolymer, styrene-methacrylate copolymer, styrene-methyl α-chloroacrylate copolymer, and styrene-acrylonitrile-acrylate copolymer, as well as epoxy resins, vinyl chloride resins, rosin-modified maleic acid resins, phenol resins, polyethylene resins, polypropylene resins, petroleum resins, polyurethane resins, ketone resins, ethylene-ethyl acrylate copolymer, xylene resins, and polyvinyl butyrate resins. The production method of these resins is also not particularly limited, and any of bulk polymerization, solution polymerization, emulsion polymerization, and suspension polymerization can be employed.

In the present embodiment, the binder resin preferably includes a polyester resin. More preferably, the binder resin includes a polyester resin as a main component. Polyester resin can be fixed at lower temperatures compared with other resins while maintaining storage stability resistant to high temperature and high humidity. Therefore, polyester resin is suitable for the binder resin of the present embodiment in view of compatibility with the fatty acid amide.

The amount of the binder resin in the toner is not particularly limited and can be suitably selected to suit to a particular application. Preferably, the amount of the binder resin in 100 parts by mass of the toner is from 60 to 95 parts by mass, more preferably from 75 to 90 parts by mass.

The polyester resin according to an embodiment of the present invention is obtained by polycondensation of an alcohol with a carboxylic acid.

Specific examples of the alcohol include, but are not limited to, glycols such as ethylene glycol, diethylene glycol, triethylene glycol, and propylene glycol, etherified bisphenols such as 1,4-bis(hydroxymethyl)cyclohexane and bisphenol A, other divalent alcohol monomers, and trivalent or higher polyvalent alcohol monomers.

Specific examples of the carboxylic acid include, but are not limited to, divalent organic acid monomers such as maleic acid, fumaric acid, phthalic acid, isophthalic acid, terephthalic acid, succinic acid, and malonic acid, and trivalent or higher polyvalent carboxylic acid monomers such as 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxypropane, and 1,2,7,8-octanetetracarboxylic acid.

Preferably, the polyester resin has a glass transition temperature (Tg) of from 50 to 70 degrees C.

Release Agent

The release agent is not particularly limited and can be suitably selected to suit to a particular application. One release agent may be used alone, or two or more release agents may be used in combination.

Examples of the release agent include, but are not limited to: aliphatic hydrocarbons such as liquid paraffin, microcrystalline wax, natural paraffin, synthetic paraffin, and polyolefin wax, and partial oxides, fluorides, and chlorides thereof; animal oils such as beef tallow and fish oil; vegetable oils such as coconut oil, soybean oil, rapeseed oil, rice bran wax, and carnauba wax; higher aliphatic alcohols and higher fatty acids such as montan wax; fatty acid amides and fatty acid bisamides; metal soaps such as zinc stearate, calcium stearate, magnesium stearate, aluminum stearate, zinc oleate, zinc palmitate, magnesium palmitate, zinc myristate, zinc laurate, and zinc behenate; fatty acid esters; and polyvinylidene fluoride. Preferably, the release agent comprises an ester wax. Since the ester wax has low compatibility with general polyester binder resins, the ester wax easily exudes out to the surface of the toner at the time the toner gets fixed. Thus, the toner exhibits high releasability while securing sufficient low-temperature fixability. More preferably, the ester wax comprises a synthetic monoester wax. Examples of the synthetic monoester wax include, but are not limited to, a monoester wax synthesized from a long-chain linear saturated fatty acid and a long-chain linear saturated alcohol. Specific examples of the long-chain linear saturated fatty acid include, but are not limited to, capric acid, undecylic acid, lauric acid, tridecylic acid, myristic acid, pentadecylic acid, palmitic acid, heptadecanoic acid, tetradecanoic acid, stearic acid, nonadecanoic acid, arachidic acid, behenic acid, lignoceric acid, cerotic acid, heptacosanoic acid, montanic acid, and melissic acid. Specific examples of the long-chain linear saturated alcohol include, but are not limited to, amyl alcohol, hexyl alcohol, heptyl alcohol, octyl alcohol, capryl alcohol, nonyl alcohol, decyl alcohol, undecyl alcohol, lauryl alcohol, tridecyl alcohol, myristyl alcohol, pentadecyl alcohol, cetyl alcohol, heptadecyl alcohol, stearyl alcohol, nonadecyl alcohol, eicosyl alcohol, ceryl alcohol, behenyl alcohol, and heptadecanol, all of which may have a substituent such as a lower alkyl group, an amino group, and a halogen. By the use of the synthetic monoester wax, the amount of particles generated at the time when the toner is overheated to get fixed is reduced, and contamination of the inside of the machine using the toner is reduced.

Preferably, the ester wax has a melting point of from 65 to 80 degrees C. When the melting point is 65 degrees C. or higher, thermal properties of the toner are improved, and undesired phenomena are prevented such as generation of aggregates, toner filming on photoconductors, and white spots in images. When the melting point is 80 degrees C. or lower, the toner easily exudes out from the toner at the time when the toner gets fixed, thus improving low-temperature fixability.

Preferably, the amount of the release agent in 100 parts by mass of the toner is from 4 to 8 parts by mass, more preferably from 5 to 7 parts by mass. When the amount is 4 parts by mass or more, a sufficient amount of the release agent exudes out to the surface of the toner at the time the toner gets fixed, thereby improving releasability, low-temperature fixability, and high-temperature offset resistance. When the amount is 8 parts by mass or less, the amount of the release agent deposited on the surface of the toner image does not excessively increase, thereby improving storage stability and resistance to filming (on a photoconductor, etc.) of the toner.

Charge Controlling Agent

The toner may contain a charge controlling agent.

The charge controlling agent is not particularly limited and can be suitably selected to suit to a particular application. Examples thereof include, but are not limited to: nigrosine and modified products with fatty acid metal salts; onium salts such as phosphonium salt and lake pigments thereof; triphenylmethane dyes and lake pigments thereof; metal salts of higher fatty acids; diorganotin oxides such as dibutyltin oxide, dioctyltin oxide, and dicyclohexyltin oxide; diorganotin borates such as dibutyltin borate, dioctyltin borate, and dicyclohexyltin borate; organometallic complexes, chelate compounds, monoazo metal complexes, acetylacetone metal complexes, and metal complexes of aromatic hydroxycarboxylic acids and aromatic dicarboxylic acids; quaternary ammonium salts; aromatic hydroxycarboxylic acids and aromatic mono- and poly-carboxylic acids and metal salts, anhydrides, and esters thereof; and phenol derivatives such as bisphenols.

Each of these materials can be used alone or in combination with others.

When the charge controlling agent is added to the inside of the toner, the amount thereof is preferably from 0.1 to 10 parts by mass based on 100 parts by mass of the binder resin. To prevent undesirable coloring of the toner by the charge controlling agent, a transparent material is preferably selected except for the case of black toner.

Wax Dispersing Agent

The toner according to an embodiment of the present invention preferably contains a wax dispersing agent. Preferably, the wax dispersing agent is a copolymer composition comprising at least styrene, butyl acrylate, and acrylonitrile as monomers, or a polyethylene adduct of the copolymer composition.

Generally, styrene resin is more compatible with general waxes compared with polyester resin, and the wax dispersed in the styrene resin tends to be small in size. In addition, styrene resin has a weaker internal cohesive force and better pulverizability as compared with polyester resin. Therefore, even when the dispersion state of wax in styrene resin is equivalent to that in polyester resin, it is less likely that the interface between the wax and the styrene resin becomes a pulverization surface compared with the interface between the wax and the polyester resin. Styrene resin is capable of preventing the wax from being exposed at the surfaces of the toner particles, thereby improving heat-resistant storage stability of the toner.

A combination of styrene resin and polyester resin is likely to lower the image gloss because they are incompatible with each other. The above-described copolymer composition comprising butyl acrylate as an acrylic species, which is one type of typical styrene resins, has a solubility parameter close to that of polyester resin. Therefore, when this copolymer composition is used as the wax dispersing agent, lowering of the image gloss is prevented even though it is incompatible with the binder resin. Since the acrylic species is butyl acrylate, thermal properties of the copolymer composition are similar to those of polyester resin. Therefore, the copolymer composition does not largely disturb low-temperature fixability and internal cohesive force of the polyester resin.

The amount of the wax dispersing agent in 100 parts by mass of the toner is preferably 7 parts by mass or less. The wax dispersing agent has an effect of dispersing the wax in the toner, so that storage stability of the toner is reliably improved regardless of production method of the toner. In addition, the diameter of the wax is reduced due to the effect of the wax dispersing agent, so that the toner is prevented from filming on a photoconductor, etc. When the amount is 7 parts by mass or less, the amount of polyester-incompatible components is not excessive so that a gloss decrease is prevented. Also, dispersibility of the wax is not excessive, so that the wax sufficiently exudes out to the surface of the toner at the time the toner gets fixed, improving low-temperature fixability and hot offset resistance.

Colorant

Specific examples of the colorant include, but are not limited to, known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarin Lake, Thioindigo Red B, Thioindigo Maroon, Oil Red, Quinacridone Red, Pyrazolone Red, polyazo red, Chrome Vermilion, Benzidine Orange, Perinone Orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, and combinations thereof.

The proportion of the colorant in the toner is typically from 1% to 15% by mass, and preferably from 3% to 10% by mass.

The colorant can be combined with a resin to be used as a master batch.

Specific examples of the resin to be used for the master batch include, but are not limited to, polymers of styrene or a styrene-substituted body (e.g., polystyrene, poly-p-chlorostyrene, polyvinyl toluene) and copolymer thereof with vinyl compounds, polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, paraffin wax, and combinations thereof.

External Additive

Specific examples of usable external additives include, but are not limited to: abrasive agents such as silica, cerium oxide powder, silicon carbide powder, and strontium titanate powder; fluidity imparting agents and aggregation preventing agents, such as titanium oxide powder and aluminum oxide powder; conductivity imparting agents such as zinc oxide powder, antimony oxide powder, and tin oxide powder; and developability improving agents such as reverse-polarity white particles and black particles. Each of these materials can be used alone or in combination with others. The external additive is so selected that the toner is imparted with resistance to stress caused by, for example, idling in the developing process.

Preferably, the external additive of the toner according to an embodiment of the present invention comprises silica particles. For improving dispersibility, silica particles having a hydrophobized surface are more preferred. Silica particles may be hydrophobized by coating the surfaces thereof with an alkyl group, specifically by, for example, acting a known organosilicon compound having an alkyl group on the silica particles.

Examples of usable hydrophobizing agent include, but are not limited to, known organosilicon compounds having an alkyl group (such as methyl group, ethyl group, propyl group, and butyl group). Specific examples thereof include, but are not limited to, silane compounds (e.g., methyltrimethoxysilane, dimethyldimethoxysilane, trimethylchlorosilane, trimethylmethoxysilane) and silazane compounds (e.g., hexamethyldisilazane, tetramethyldisilazane). Each of these hydrophobizing agents may be used alone or in combination with the others. Among these hydrophobizing agents, organosilicon compounds having trimethyl group are preferred, such as trimethylmethoxysilane and hexamethyldisilazane.

Toner Production Method

The toner can be produced by any known method as long as the toner satisfies the above-described requirements. For example, the toner may be produced by a kneading pulverization method or a chemical method that granulates toner particles in an aqueous medium.

For example, the toner according to an embodiment of the present invention may be prepared as follows. First, the binder resin, the release agent, and the function imparting agent are well mixed, optionally together with the colorant, and further optionally together with the wax dispersing agent, and the charge controlling agent, etc., by a mixer such as HENSCHEL MIXER and SUPER MIXER. The mixture is then melt-kneaded by a heat melt kneader such as a heat roll, a kneader, and an extruder, so that the materials are thoroughly mixed. The kneaded mixture is cooled to solidify, then pulverized into fine particles, and the fine particles are classified by size to obtain a toner. The pulverizing process may be of a jet mill process in which a high-speed airflow incorporates toner particles to let the toner particles collide with a collision plate and be pulverized by the collision energy, an inter-particle collision process which lets toner particles collide with each other in an airflow, or a mechanical pulverizing process in which toner particles are supplied to a narrow gap formed with a rotor rotating at a high speed to be pulverized.

The toner according to an embodiment of the present invention may also be prepared by a dissolution suspension method. In this method, an oil phase is dispersed in an aqueous medium. Here, the oil phase comprises an organic solvent and toner materials dissolved or dispersed therein. After a reaction for forming a resin is conducted, removal of the solvent, filtration, washing, and drying are conducted, thus obtaining mother toner particles.

Developer

A developer according to an embodiment of the present invention comprises at least the above-described toner. The developer may be either a one-component developer or a two-component developer.

In a preferred embodiment, the toner is mixed with a carrier to form a two-component developer, which is used for an electrophotographic image forming method employing a two-component developing system.

For use in two-component developing systems, fine particles of magnetic materials may be used magnetic carriers. Specific examples of the magnetic materials include, but are not limited to: magnetites; spinel ferrites containing gamma iron oxide; spinel ferrites containing at least one metal (e.g., Mn, Ni, Zn, Mg, and Cu) other than iron; magnetoplumbite-type ferrites such as barium ferrite; and particulate iron or alloy having an oxidized layer on its surface.

The magnetic material may be in any of granular, spherical, or needle-like shape. When high magnetization is required, ferromagnetic fine particles, such as iron, are preferably used. For chemical stability, magnetites, spinel ferrites containing gamma iron oxide, and magnetoplumbite-type ferrites such as barium ferrite are preferred.

Specific preferred examples thereof include, but are not limited to, commercially-available products such as MFL-35S and MFL-35HS (available from Powdertech Co., Ltd.); and DFC-400M, DFC-410M, and SM-350NV (available from Dowa IP Creation Co., Ltd.).

A resin carrier may also be used which has a desired magnetization by containing an appropriate type of magnetic fine particles in an appropriate amount. Such a resin carrier preferably has a magnetization strength of from 30 to 150 emu/g at 1,000 oersted. Such a resin carrier may be produced by spraying a melt-kneaded product of magnetic fine particles with an insulating binder resin by a spray dryer, or dispersing magnetic fine particles in a condensation-type binder resin by reacting/curing its monomer or prepolymer in an aqueous medium in the presence of magnetic fine particles.

Chargeability of the magnetic carrier may be controlled by fixedly adhering positively-chargeable or negatively-chargeable fine particles or conductive fine particles on the surface of the magnetic carrier, or coating the magnetic carrier with a resin.

Examples of the surface coating resin include silicone resin, acrylic resin, epoxy resin, and fluorine-based resin. These resins may contain positively-chargeable or negatively-chargeable fine particles or conductive fine particles. Among these resins, silicone resin and acrylic resin are preferable.

Preferably, a mass ratio of the carrier in the developer stored in a developing device is 85% by mass or higher but less than 98% by mass. When the mass ratio is 85% by mass or higher, the toner is prevented from scattering from the developing device, thereby preventing the occurrence of defective images. When the mass ratio of the carrier in the developer is less than 98% by mass, an excessive increase of the charge amount of the toner and shortage of the toner to be supplied can be prevented, thereby effectively preventing a decrease of image density and the occurrence of defective images.

Image Forming Method and Image Forming Apparatus

An image forming apparatus according to an embodiment of the present invention includes: an electrostatic latent image bearer; an electrostatic latent image forming device configured to form an electrostatic latent image on the electrostatic latent image bearer; a developing device accommodating the above-described toner, configured to develop the electrostatic latent image formed on the electrostatic latent image bearer with the toner to form a toner image; a transfer device configured to transfer the toner image formed on the electrostatic latent image bearer onto a surface of a recording medium; and a fixing device configured to fix the toner image on the surface of the recording medium.

An image forming method according to an embodiment of the present invention includes: an electrostatic latent image forming process that forms an electrostatic latent image on an electrostatic latent image bearer; a developing process that develops the electrostatic latent image formed on the electrostatic latent image bearer with the above-described toner to form a toner image; a transfer process that transfers the toner image formed on the electrostatic latent image bearer onto a surface of a recording medium; and a fixing process that fixes the toner image on the surface of the recording medium. Preferably, the image forming method may further include a recycle process that cleans the surface of the electrostatic latent image bearer (hereinafter may be referred to as "photoconductor") after the toner image has been transferred onto the recording medium to collect toner remaining thereon and supply the collected toner to the developing device for use in the developing process.

Details of the image forming method and the image forming apparatus are described below.

FIG. 1 is a schematic view of a full-color image forming apparatus employing the image forming method according to an embodiment of the present invention.

The image forming apparatus illustrated in FIG. 1 includes a drive roller 101A, a driven roller 101B, a photoconductor belt 102, a charger 103, a laser writing unit 104, developing units 105A to 105D respectively containing yellow, magenta, cyan, and black toners, a sheet tray 106, an intermediate transfer belt 107, a drive shaft roller 107A for driving the intermediate transfer belt 107, a pair of driven shaft rollers 107B for supporting the intermediate transfer belt 107, a cleaner 108, a fixing roller 109, a pressure roller 109A, a sheet ejection tray 110, and a sheet transfer roller 113.

The intermediate transfer belt 107 has flexibility. The intermediate transfer belt 107 is stretched taut with the drive shaft roller 107A and the pair of driven shaft rollers 107B and circulatingly conveyed clockwise in FIG. 1. A part of the surface of the intermediate transfer belt 107 stretched between the driven shaft rollers 107B is in contact with the photoconductor belt 102, wound around the outer periphery of the drive roller 101A, in a horizontal direction.

In a regular full-color image forming operation, each time a toner image is formed on the photoconductor belt 102, the toner image is immediately transferred onto the intermediate transfer belt 107 to form a full-color composite toner image. The full-color composite toner image is transferred onto a transfer sheet that is fed from the sheet tray 106 by the sheet transfer roller 113. The transfer sheet having the composite toner image thereon is conveyed to between the fixing roller 109 and the pressure roller 109A in a fixing device. After the composite toner image is fixed on the transfer sheet by the fixing roller 109 and the pressure roller 109A, the transfer sheet is ejected on the sheet ejection tray 110.

As the developing units 105A to 105D develop images with respective toners, the toner concentration in each developer contained in each developing unit is decreased. A decrease of toner concentration in the developer is detected by a toner concentration sensor. As a decrease of toner concentration is detected, toner supply devices connected to respective developing units start operation to supply toner and increase toner concentration. In a case in which the developing unit is equipped with a developer ejection mechanism, a developer exclusive for trickle development in which the toner is mixed with a carrier may be supplied in place of the toner.

According to another embodiment, toner images may be directly transferred from a transfer drum onto a recording medium without being transferred onto an intermediate transfer belt in a superimposed manner as is the case illustrated in FIG. 1.

Figure 2:
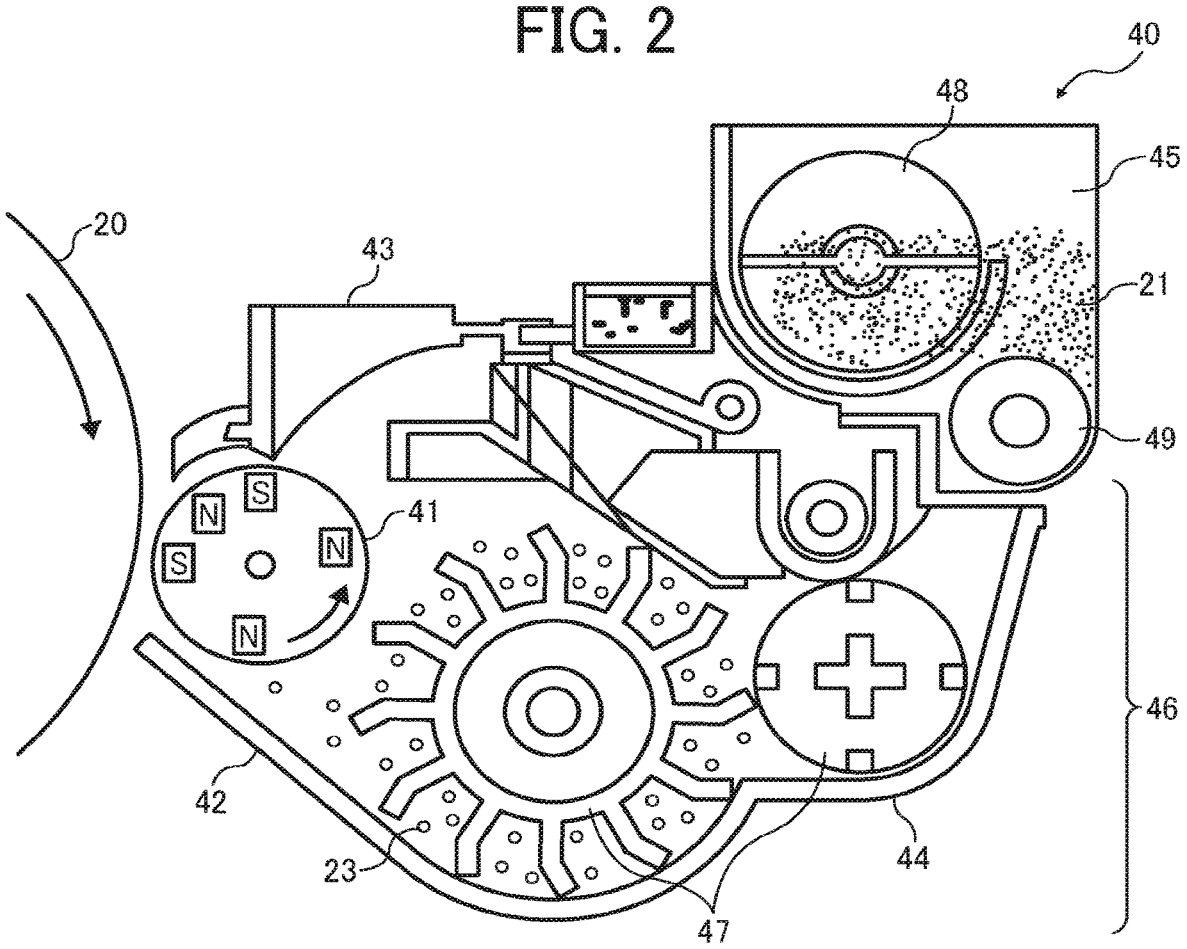
FIG. 2 is a schematic view of a developing device according to an embodiment of the present invention.

FIG. 2 is a schematic view of a developing device according to an embodiment of the present invention.

Referring to FIG. 2, a developing device 40 is disposed facing a photoconductor 20 serving as an electrostatic latent image bearer. The developing device 40 includes a developing sleeve 41 serving as a developer bearer, a developer housing 42, a doctor blade 43 serving as a regulator, and a support casing 44.

The support casing 44 has an opening on the photoconductor 20 side. A toner hopper 45, serving as a toner container, containing a toner 21 is joined to the support casing 44. A developer container 46 contains a developer comprising the toner 21 and a carrier 23, and is disposed adjacent to the toner hopper 45. Inside the developer container 46, a developer stirring mechanism 47 is disposed configured to stir the toner 21 and the carrier 23 to give triboelectric/separation charge to the toner 21.

Inside the toner hopper 45, a toner agitator 48 and a toner supply mechanism 49 are disposed. The toner agitator 48 is driven to rotate by a driver. The toner agitator 48 and the toner supply mechanism 49 feed the toner 21 contained in the toner hopper 45 toward the developer container 46 by agitating the toner.

The developing sleeve 41 is disposed within a space formed between the photoconductor 20 and the toner hopper 45. The developing sleeve 41 is driven to rotate in a direction indicated by arrow in FIG. 2. Inside the developing sleeve 41, magnets serving as magnetic field generators are disposed with the relative positions thereof invariant to the developing device, for forming a magnetic brush of the carrier 23.

The doctor blade 43 is integrally installed to one side of the developer housing 42 opposite to a side to which the support casing 44 is installed. An edge of the doctor blade 43 is disposed facing the outer circumferential surface of the developing sleeve 41 forming a constant gap therebetween.

With the above configuration, the toner 21 is fed from the toner hopper 45 to the developer container 46 by the toner agitator 48 and the toner supply mechanism 49. The toner 21 is then stirred by the developer stirring mechanism 47 to be given a desired triboelectric/separation charge. The charged toner 21 is carried on the developing sleeve 41 together with the carrier 23 and conveyed to a position where the developing sleeve 41 faces the outer circumferential surface of the photoconductor 20. The toner 21 is electrostatically bound to an electrostatic latent image formed on the photoconductor 20, thus forming a toner image on the photoconductor 20.

Figure 3:
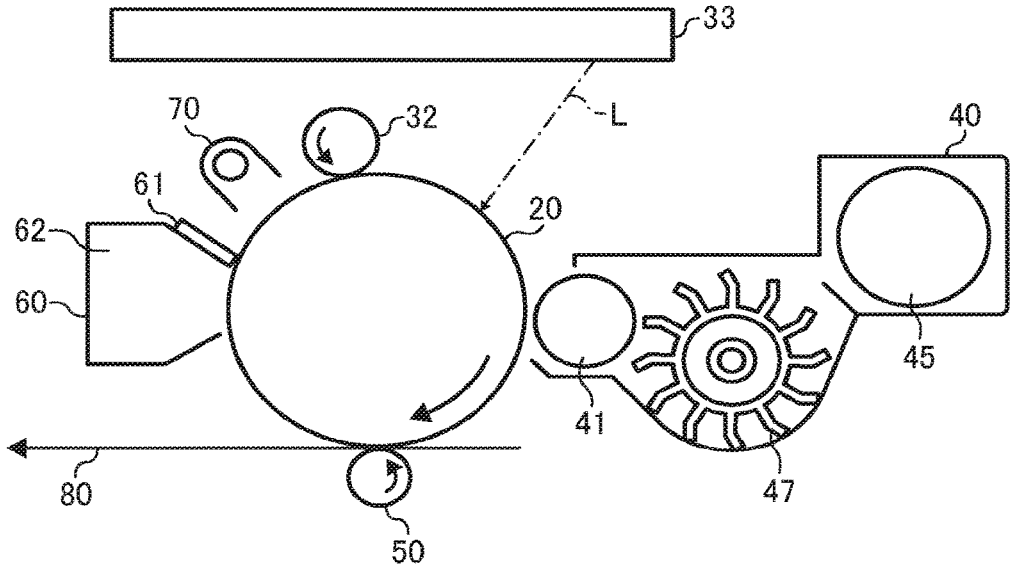
FIG. 3 is a schematic view of an image forming apparatus including the developing device illustrated in FIG. 2.

FIG. 3 is a schematic view of an image forming apparatus including the developing device illustrated in FIG. 2. This image forming apparatus includes a charger 32, an irradiator 33, the developing device 40, a transfer device 50, a cleaner 60, and a neutralization lamp 70, each of which being disposed around the photoconductor 20 having a drum-like shape. The charger 32 and the photoconductor 20 are out of contact with each other forming a gap having a distance of about 0.2 mm therebetween. The charger 32 charges the photoconductor 20 by forming an electric field in which an alternating current component is superimposed on a direct current component by a voltage applicator, thus effectively reducing charging unevenness.

A series of image forming processes can be explained based on a negative-positive developing mechanism. The photoconductor 20, represented by an organic photoconductor (OPC) having an organic photoconductive layer, is neutralized by the neutralization lamp 70, uniformly negatively charged by the charger 32 (e.g., charging roller), and irradiated with laser light L emitted from the irradiator 33, so that a latent image is formed thereon. In this case, the absolute value of the potential of the irradiated potion is lower than that of the non-irradiated portion.

The laser light L is emitted from a semiconductor laser and reflected by a polygon mirror that is rotating at a high speed, thus scanning the surface of the photoconductor 20 in its rotational axis direction. The latent image thus formed is developed into a toner image with a developer comprising toner and carrier having been supplied onto the developing sleeve 41 (serving as a developer bearer) disposed in the developing device 40. In developing the latent image, a voltage applicator applies a developing bias to between the developing sleeve 41 and the irradiated and non-irradiated portions on the photoconductor 20. The developing bias is a direct current voltage of an appropriate magnitude or that on which an alternating current is superimposed.

At the same time, a transfer medium 80 (e.g., paper sheet) is fed from a sheet feeding mechanism to between the photoconductor 20 and the transfer device 50 by a registration roller pair in synchronization with an entry of a leading edge of an image thereto, thus transferring the toner image onto the transfer medium 80. At this time, the transfer device 50 is preferably applied with a transfer bias having the opposite polarity to the toner charge. The transfer medium 80 is thereafter separated from the photoconductor 20, thus obtaining a transfer image.

Residual toner particles remaining on the photoconductor 20 are collected by a cleaning blade 61 into a toner collection chamber 62 disposed in the cleaner 60.

The collected toner particles may be conveyed to the developer container 46 and/or the toner hopper 45 by a toner recycler to be reused.

The image forming apparatus includes a plurality of the above developing devices. A plurality of toner images may be sequentially transferred onto the transfer medium and thereafter fed to a fixing device to be fixed on the transfer medium by heat. Alternatively, a plurality of toner images may be once transferred onto an intermediate transfer medium and then transferred onto the transfer medium all at once and fixed thereon.

Figure 4:
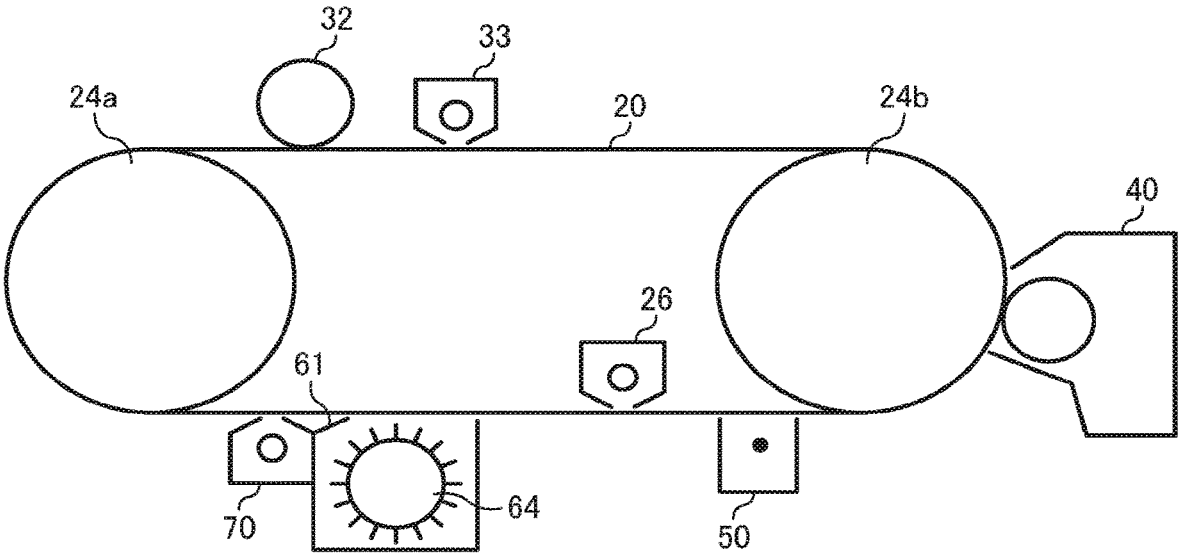
FIG. 4 is a schematic view of another image forming apparatus according to an embodiment of the present invention.

FIG. 4 is a schematic view of another image forming apparatus according to an embodiment of the present invention. In this image forming apparatus, a photoconductor 20 comprises a conductive substrate and a photosensitive layer disposed thereon. The photoconductor 20 is driven by drive rollers 24*a* and 24*b*, charged by a charger 32, and irradiated with light emitted from an irradiator 33, so that a latent image is formed thereon. The latent image is developed by a developing device 40 and transferred by a transfer device 50. The photoconductor 20 is irradiated with light emitted from a pre-cleaning irradiator 26 before being cleaned, cleaned by a brush cleaner 64 and a cleaning blade 61, and neutralized by a neutralization lamp 70. These operations are repeatedly performed. In the embodiment illustrated in FIG. 4, the photoconductor 20 is irradiated with light from the substrate side before being cleaned. In this case, the substrate is light-transmissive.

Toner Accommodating Unit

In the present disclosure, a toner accommodating unit refers to a unit having a function of accommodating toner and accommodating the toner. The toner accommodating unit may be in the form of, for example, a toner container, a developing device, or a process cartridge.

The toner container refers to a container containing the toner.

The developing device refers to a device accommodating the toner and having a developing unit configured to develop an electrostatic latent image into a toner image with the toner.

The process cartridge refers to a combined body of an electrostatic latent image bearer (also referred to as an image bearer) with a developing unit accommodating the toner, detachably mountable on an image forming apparatus. The process cartridge may further include at least one of a charger, an irradiator, and a cleaner.

EXAMPLES

Hereinafter, the present invention is described in detail with reference to the following examples.

Further understanding of the present disclosure can be obtained by reference to certain specific examples provided herein below for the purpose of illustration only and are not intended to be limiting.

In the following descriptions, "parts" represent "parts by mass" unless otherwise specified.

Resin Production Examples

Production of Polyester Resin A

A 5-liter autoclave equipped with a distillation tower was charged with 4,000 g of monomers comprising aromatic diol components comprising 25% by mol of propylene oxide 3-mol adduct of bisphenol A and 25% by mol of ethylene glycol and carboxylic acid components comprising 20% by mol of adipic acid, 10% by mol of terephthalic acid, 10% by mol of isophthalic acid, and 10% by mol of trimellitic acid. The monomers were subjected to an esterification reaction at 170 to 260 degrees C. at normal pressure in the absence of catalyst. Antimony trioxide in an amount of 400 ppm based on all the carboxylic acid components was thereafter added to the reaction system, and a polycondensation was conducted at 250 degrees C. under vacuum (3 Torr) while removing glycol out of the reaction system. Thus, a polyester resin A was prepared. The glass transition temperature of the polyester resin A was 61 degrees C.

Production of Polyester Resin B

A 5-liter autoclave equipped with a distillation tower was charged with 4,000 g of monomers comprising aromatic diol components comprising 25% by mol of propylene oxide 3-mol adduct of bisphenol A and 25% by mol of ethylene oxide 2-mol adduct of bisphenol A and carboxylic acid components comprising 50% by mol of terephthalic acid. The monomers were subjected to an esterification reaction at 170 to 260 degrees C. at normal pressure in the absence of catalyst. Antimony trioxide in an amount of 400 ppm based on all the carboxylic acid components was thereafter added to the reaction system, and a polycondensation was conducted at 250 degrees C. under vacuum (3 Torr) while removing glycol out of the reaction system. Thus, a polyester resin B was prepared. The glass transition temperature of the polyester resin B was 65 degrees C.

Production of Polyester Resin C

A 5-liter autoclave equipped with a distillation tower was charged with 4,000 g of monomers comprising aromatic diol components comprising 20% by mol of ethylene oxide 2-mol adduct of bisphenol A and 30% by mol of propylene oxide 3-mol adduct of bisphenol A and carboxylic acid components comprising 50% by mol of terephthalic acid. The monomers were subjected to an esterification reaction at 170 to 260 degrees C. at normal pressure in the absence of catalyst. Antimony trioxide in an amount of 400 ppm based on all the carboxylic acid components was thereafter added to the reaction system, and a polycondensation was conducted at 250 degrees C. under vacuum (3 Torr) while removing glycol out of the reaction system. Thus, a polyester resin C was prepared. The glass transition temperature of the polyester resin C was 70 degrees C.

Release Agent Production Example

Production of Ester Wax 1

A 1-liter four-neck flask equipped with a thermometer, a nitrogen introducing tube, a stirrer, and a condenser tube was charged with fatty acid components comprising 100 parts by mass of stearic acid and alcohol components comprising 100 parts by mass of behenyl alcohol. The total amount of the fatty acid components and the alcohol components was 500 g. These components were subjected to a reaction at 220 degrees C. at normal pressure for 15 hours or more under nitrogen gas flow while distilling reaction products away. Thus, an ester wax 1 was prepared. The melting point of the ester wax 1 was 67 degrees C.

Examples 1 to 9 and Comparative Examples 1 to 6

Toner Production Method

Production of Toner 1

Polyester resin A: 90.0 parts
Styrene acrylic copolymer (EXD-001 available from Sanyo Chemical Industries, Ltd.): 5.0 parts
Ester wax 1:5.0 parts
Salicylic acid derivative zirconium salt: 0.9 parts
Carbon black (C-44 available from Mitsui Chemicals, Inc.): 6.0 parts
Behenamide (having a melting point of 111 degrees C.): 2.0 parts The toner raw materials listed above were preliminarily mixed by a HENSCHEL MIXER (FM20B available from NIPPON COKE & ENGINEERING CO., LTD.) and melt-kneaded by a single-shaft kneader (BUSS CO-KNEADER from Buss AG) at a temperature of from 100 to 130 degrees C. The kneaded product was cooled to room temperature and pulverized into coarse particles having a diameter of from 200 to 300 μm by a ROTOPLEX. The coarse particles were further pulverized into fine particles having a weight average particle diameter of 6.5±0.3 μm by a COUNTER JET MILL (100AFG available from Hosokawa Micron Corporation) while appropriately adjusting the pulverization air pressure. The fine particles were classified by size using an air classifier (EJ-LABO available from MATSUBO Corporation) while appropriately adjusting the opening of the louver such that the weight average particle diameter became 7±0.2 μm and the ratio of weight average particle diameter to number average particle diameter became 1.25 or less. Thus, a mother toner 1 was prepared.

Next, 100 parts of the mother toner 1 were stir-mixed with additives including 1.0 part of HDK-2000 and 1.0 part of H05TD, both available from Clariant, by a HENSCHEL MIXER. Thus, a toner 1 was prepared.

Production of Toner 2

A toner 2 was prepared in the same manner as the toner 1 except that the amount of behenamide was changed from 2.0 parts to 5.0 parts.

Production of Toner 3

A toner 3 was prepared in the same manner as the toner 1 except that the behenamide was replaced with stearamide (ALFLOW S-10 available from NOF CORPORATION, having a melting point of 101 degrees C.).

Production of Toner 4

A toner 4 was prepared in the same manner as the toner 1 except that the behenamide was replaced with erucamide (ALFLOW P-10 available from NOF CORPORATION, having a melting point of 80 degrees C.).

Production of Toner 5

A toner 5 was prepared in the same manner as the toner 1 except that the amount of behenamide was changed from 2.0 parts to 0.5 parts.

Production of Toner 6

A toner 6 was prepared in the same manner as the toner 1 except that the behenamide was replaced with ethylenebis stearamide (KAO WAX EB available from Kao Corporation, having a melting point of 145 degrees C.).

Production of Toner 7

A toner 7 was prepared in the same manner as the toner 1 except that the behenamide was replaced with ethylenebis lauramide (SLIPACKS L available from Mitsubishi Chemical Corporation (formerly available from Nippon Kasei Chemical Company Limited), having a melting point of 157 degrees C.).

Production of Toner 8

A toner 8 was prepared in the same manner as the toner 1 except that the polyester resin A was replaced with a styrene-acrylic resin (DIANAL FB-1788 available from Mitsubishi Chemical Corporation (formerly available from MITSUBISHI RAYON CO., LTD.)).

Production of Toner 9

A toner 9 was prepared in the same manner as the toner 1 except that the ester wax 1 was replaced with an ester wax 2 (WEP-8 available from NOF CORPORATION, having a melting point of 79 degrees C.).

Production of Toner 10

A toner 10 was prepared in the same manner as the toner 1 except that the ester wax 1 was replaced with a micro-crystalline wax (Hi-Mic-1045 available from Nippon Seiro Co., Ltd., having a melting point of 71 degrees C.).

Production of Toner 11

A toner 11 was prepared in the same manner as the toner 1 except that the amount of behenamide was changed from 2.0 parts to 0 part.

Production of Toner 12

A toner 12 was prepared in the same manner as the toner 9 except that the polyester resin A was replaced with the polyester resin C and the amount of behenamide was changed from 2.0 parts to 0 part.

Production of Toner 13

A toner 13 was prepared in the same manner as the toner 1 except that the polyester resin A was replaced with the polyester resin B.

Production of Toner 14

A toner 14 was prepared in the same manner as the toner 1 except that the polyester resin A was replaced with polyester resin B and the ester wax 1 was replaced with the ester wax 2 (WEP-8 available from NOF CORPORATION, having a melting point of 79 degrees C.).

Production of Toner 15

A toner 15 was prepared in the same manner as the toner 9 except that the polyester resin A was replaced with the polyester resin C.

The toners 1 to 15 were prepared as described above. The binder resins, release agents (and the melting points thereof), and fatty acid amides (and the added amounts and melting points thereof) used for each toner are shown in Table 1.

TABLE 1

| Examples/ Comparative Examples | | Binder Resin | Release Agent | Melting Point | Function Imparting Agent | Addition Amount | Melting Point |
|---|---|---|---|---|---|---|---|
| Example 1 | Toner 1 | Polyester Resin A | Ester Wax 1 | 67 deg. C. | Behenamide | 2.0 | 111 deg. C. |
| Comparative Example 1 | Toner 2 | Polyester Resin A | Ester Wax 1 | 67 deg. C. | Behenamide | 5.0 | 111 deg. C. |
| Comparative Example 2 | Toner 3 | Polyester Resin A | Ester Wax 1 | 67 deg. C. | Stearamide | 2.0 | 101 deg. C. |
| Comparative Example 3 | Toner 4 | Polyester Resin A | Ester Wax 1 | 67 deg. C. | Erucamide | 2.0 | 80 deg. C. |
| Example 2 | Toner 5 | Polyester Resin A | Ester Wax 1 | 67 deg. C. | Behenamide | 0.5 | 111 deg. C. |
| Example 3 | Toner 6 | Polyester Resin A | Ester Wax 1 | 67 deg. C. | Ethylenebis Stearamide | 2.0 | 145 deg. C. |
| Example 4 | Toner 7 | Polyester Resin A | Ester Wax 1 | 67 deg. C. | Ethylenebis Lauramide | 2.0 | 157 deg. C. |
| Comparative Example 4 | Toner 8 | Styrene Acrylic Resin | Ester Wax 1 | 67 deg. C. | Behenamide | 2.0 | 111 deg. C. |
| Example 5 | Toner 9 | Polyester Resin A | Ester Wax 2 | 79 deg. C. | Behenamide | 2.0 | 111 deg. C. |
| Example 6 | Toner 10 | Polyester Resin A | Micro-crystalline Wax | 71 deg. C. | Behenamide | 2.0 | 111 deg. C. |
| Comparative Example 5 | Toner 11 | Polyester Resin A | Ester Wax 1 | 67 deg. C. | — | 0 | None |
| Comparative Example 6 | Toner 12 | Polyester Resin C | Ester Wax 2 | 79 deg. C. | — | 0 | None |
| Example 7 | Toner 13 | Polyester Resin B | Ester Wax 1 | 67 deg. C. | Behenamide | 2.0 | 111 deg. C. |
| Example 8 | Toner 14 | Polyester Resin B | Ester Wax 2 | 79 deg. C. | Behenamide | 2.0 | 111 deg. C. |
| Example 9 | Toner 15 | Polyester Resin C | Ester Wax 2 | 79 deg. C. | Behenamide | 2.0 | 111 deg. C. |

For each toner, the presence or absence of an endothermic peak within a temperature range of ±20 degrees C. of a temperature at the highest endothermic peak derived from the fatty acid amide in temperature rising by a differential scanning calorimeter (DSC), the presence or absence of a peak derived from the function imparting agent in a TOF-SIMS measurement, and the structure of the fatty acid amide are shown in Table 2.

Measurement of Highest Endothermic Peak of Fatty Acid Amide and Endothermic Peak of Toner First, about 5.0 mg of the fatty acid amide or toner was put in a sample container made of aluminum. The sample container was put on a holder unit of a differential scanning calorimeter (DSC 60 available from Shimadzu Corporation) and set in an electric furnace. The temperature was raised from 0 degrees C. to 180 degrees C. at a temperature rising rate of 10 degrees C./min in nitrogen atmosphere. The temperature was thereafter lowered from 180 degrees C. to 0 degrees C. at a temperature falling rate of 10 degrees C./min and raised to 180 degrees C. again at a temperature rising rate of 10 degrees C./min to obtain a DSC curve. The DSC curve was analyzed with analysis program installed in DSC-60 to determine an endothermic peak in the first temperature rising. The temperature at the highest endothermic peak of the fatty acid amide was determined as the melting point of the fatty acid amide. The DSC curve of the toner was analyzed to confirm whether an endothermic peak was present or absent within a temperature range of ±20 degrees C. of a temperature at the highest endothermic peak derived from the fatty acid amide.

TOF-SIMS Measurement

The toner with a deposition amount of 0.85 mg/cm$^2$ was fixed at a fixing temperature of 160 degrees C. to prepare a fixed image sample. The fixed image sample was subjected to a measurement by a TOF-SIMS instrument (TOF.SIMS 5 available from IONTOF GmbH) under the following conditions to obtain a mass spectrum: the primary ion source being Bi3++, the primary ion acceleration voltage being 30 kV, the primary ion current being 0.41 pA, the secondary ion polarity being positive, the measurement area being 500×500 μm$^2$ and 128×128 pixel, and the integration count being 64 scans, with charge neutralization correction. Whether a peak derived from the function imparting agent was present or absent was confirmed.

TABLE 2

| Examples/ Comparative Examples | | Endo-thermic Peak | TOF-SIMS Measurement Result | Structure |
|---|---|---|---|---|
| Example 1 | Toner 1 | No | Yes | Primary Amide |
| Comparative Example 1 | Toner 2 | Yes | Yes | Primary Amide |
| Comparative Example 2 | Toner 3 | No | Yes | Primary Amide |
| Comparative Example 3 | Toner 4 | No | Yes | Primary Amide |
| Example 2 | Toner 5 | No | Yes | Primary Amide |
| Example 3 | Toner 6 | No | Yes | Secondary Amide |
| Example 4 | Toner 7 | No | Yes | Secondary Amide |
| Comparative Example 4 | Toner 8 | Yes | Yes | Primary Amide |
| Example 5 | Toner 9 | No | Yes | Primary Amide |
| Example 6 | Toner 10 | No | Yes | Primary Amide |
| Comparative Example 5 | Toner 11 | No | No | — |
| Comparative Example 6 | Toner 12 | No | No | — |
| Example 7 | Toner 13 | No | Yes | Primary Amide |
| Example 8 | Toner 14 | No | Yes | Primary Amide |
| Example 9 | Toner 15 | No | Yes | Primary Amide |

Production of Two-component Developer

Preparation of Carrier A

Silicone resin (Organo straight silicone): 100 parts

Toluene: 100 parts

γ-(2-Aminoethyl) aminopropyl trimethoxysilane: 5 parts

Carbon black: 10 parts

The above materials were dispersed by a homomixer for 20 minutes to prepare a coating layer forming liquid. Manganese (Mn) ferrite particles having a weight average particle diameter of 35 μm as core materials were coated with the coating layer forming liquid using a fluidized bed coating device while controlling the temperature inside the fluidized bed to 70 degrees C., followed by drying, so that the coating layer was formed on the surface of the core materials with an average film thickness of 0.20 μm.

The core materials having the coating layer were burnt in an electric furnace at 180 degrees C. for 2 hours. Thus, a carrier A was prepared.

Preparation of Two-Component Developer

The toner was uniformly mixed with the carrier A by a TURBULA MIXER (available from Willy A. Bachofen (WAB)) at a revolution of 48 rpm for 5 minutes to be charged. Thus, a two-component developer was prepared. The mixing ratio of the toner to the carrier was 4% by mass, which was equal to the initial toner concentration in the developer in the test machine.

Evaluations

The two-component developers containing the respective toners 1 to 12 were subjected to the following evaluations.

Blocking Resistance

Each developer was set in a modified digital full-color multifunction peripheral IMAGIO NEO C600 (manufactured by Ricoh Co., Ltd.) having a linear velocity of 280 mm/sec. A 4-cm square solid image having a toner deposition amount of 0.85 mg/cm$^2$ was formed and fixed on a sheet by a fixing roller with a nip width of 10 mm and a temperature of 160 degrees C. Two sheets each having the image fixed thereon were superimposed with the fixed images facing each other and a 60-g weight was put thereon, then stored in a thermostatic chamber at 70 degrees C. for 24 hours. After taken out from the thermostatic chamber, the superimposed sheets were cooled for 1 hour or more and then peeled from each other. Blocking resistance was evaluated by the condition of the images and the sound at the time of peeling off the sheets from each other based on the following criteria.

Evaluation Criteria

A: No image-peeled portion observed, and no peeling sound perceived.

B: No image-peeled portion observed, but peeling sound perceived.

C: At most 10 image-peeled portions observed, and peeling sound perceived.

D: At least 11 image-peeled portions observed, and peeling sound perceived.

Durability

Each developer was put in a digital full-color multifunction peripheral MP C306 (manufactured by Ricoh Co., Ltd.), and a chart having an image density of 20% was output on 10,000 sheets. Durability was evaluated by the condition of an image which was output thereafter.

Evaluation Criteria

A: No abnormal image was produced.

B: An abnormal image was produced on or after 8,000th sheet.

C: An abnormal image was produced on or after 5,000th sheet.

D: An abnormal image was produced on with less than 5,000th sheet.

Amount of Generation of Particles during Heating at 210 Degrees C.

About 1.0 g of the toner was placed in a 50-ml screw vial and placed on a hot plate at 210 degrees C. in a sealed case. Nitrogen gas was allowed to flow from the inlet at 700 cc/min, and the amount of generation of particles during a period of 900 seconds was measured with a portable agglomerated particle counter (MODEL 3007 available from TOKYO DYLEC CORP.) that was connected to the outlet.

Evaluation Criteria

A: The number of the generated particles was less than $3.0e^{+6}$.

B: The number of the generated particles was less than $6.0e^{+6}$.

C: The number of the generated particles was less than $9.0e^{+6}$.

D: The number of the generated particles was $9.0e^{+6}$ or more.

Low-Temperature Fixability

Each developer was set in a modified digital full-color multifunction peripheral IMAGIO NEO C600 (manufactured by Ricoh Co., Ltd.) having a linear velocity of 280 mm/sec. A 4-cm square solid image having a toner deposition amount of 0.85 mg/cm$^2$ was formed on multiples sheets of PPC paper TYPE 6000 (70 W) (manufactured by Ricoh Co., Ltd.) while setting the nip width to 10 mm and varying the temperature of the fixing roller. 2 0 Whether cold offset had occurred or not was determined by visual observation of the image. The lower-limit fixable temperature was determined as the lower-limit temperature at which cold offset did not occur. Low-temperature fixability was evaluated by the lower-limit fixable temperature based on the following criteria.

Evaluation Criteria

A: The lower-limit fixable temperature was lower than 140 degrees C.

B: The lower-limit fixable temperature was 140 degrees C. or higher and lower than 145 degrees C.

C: The lower-limit fixable temperature was 145 degrees C. or higher and lower than 150 degrees C.

D: The lower-limit fixable temperature was 150 degrees C. or higher.

Comprehensive Evaluation

Comprehensive evaluation was performed based on the following criteria.

Evaluation Criteria

A: All the evaluation results were A or B.

B: None of the evaluation results was D, and one of the evaluation results was C.

C: None of the evaluation results was D, and at least two of the evaluation results were C.

D: At least one of the evaluation results was D.

It is clear from Table 3 that the toners according to some embodiments of the present invention achieve blocking resistance and low-temperature fixability at the same time, and further provide satisfactory durability which prevents production of an abnormal image. In addition, the amount of generation of particles, which is a cause of contamination of the inside of the machine, is small.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A toner, comprising:

a binder resin comprising a polyester resin;

a release agent; and a function imparting agent comprising a fatty acid amide having a melting point of from 145 to 160 degrees C., wherein, when the toner is heated by a differential scanning calorimeter, the toner exhibits no endothermic peak within a temperature range of ±20 degrees C. of a temperature at a highest endothermic peak derived from the fatty acid amide, wherein the release agent comprises an ester wax having a melting point of from 65 to 80 degrees C., and an amount of the polyester resin is from 60 to 95 parts by mass per 100 parts by mass of the toner.

2. The toner according to claim 1, wherein, when the toner is fixed at a fixing temperature of 160 degrees C. to obtain a toner image and a surface of the toner image is analyzed

TABLE 3

| Examples/ Comparative Examples | | Blocking Resistance | Charge Stability | Amount of Generation of Particles During Heating at 210 deg. C. | Low-temperature Fixability | Comprehensive Evaluation |
|---|---|---|---|---|---|---|
| Example 1 | Toner 1 | A | A | A | A | A |
| Comparative Example 1 | Toner 2 | A | D | C | A | D |
| Comparative Example 2 | Toner 3 | D | B | B | A | D |
| Comparative Example 3 | Toner 4 | D | C | B | A | D |
| Example 2 | Toner 5 | B | A | A | B | A |
| Example 3 | Toner 6 | A | A | C | B | B |
| Example 4 | Toner 7 | A | A | C | B | B |
| Comparative Example 4 | Toner 8 | A | D | B | C | D |
| Example 5 | Toner 9 | A | B | B | C | B |
| Example 6 | Toner 10 | A | B | C | C | C |
| Comparative Example 5 | Toner 11 | D | A | A | A | D |
| Comparative Example 6 | Toner 12 | A | A | B | D | D |
| Example 7 | Toner 13 | A | A | A | B | A |
| Example 8 | Toner 14 | A | A | B | C | B |
| Example 9 | Toner 15 | A | A | B | C | B |

by time-of-flight secondary ion mass spectrometry, a resulting mass spectrum exhibits a peak derived from the function imparting agent.

3. The toner according to claim 1, wherein the fatty acid amide comprises a primary amide.

4. An image forming apparatus, comprising:

an electrostatic latent image bearer;

an electrostatic latent image forming device configured to form an electrostatic latent image on the electrostatic latent image bearer;

a developing device accommodating the toner according to claim 1, configured to develop the electrostatic latent image formed on the electrostatic latent image bearer with the toner to form a toner image;

a transfer device configured to transfer the toner image formed on the electrostatic latent image bearer onto a surface of a recording medium; and a fixing device configured to fix the toner image on the surface of the recording medium.

5. An image forming method, comprising:

forming an electrostatic latent image on an electrostatic latent image bearer;

developing the electrostatic latent image formed on the electrostatic latent image bearer with the toner according to claim 1 to form a toner image;

transferring the toner image formed on the electrostatic latent image bearer onto a surface of a recording medium; and fixing the toner image on the surface of the recording medium.

6. A toner accommodating unit, comprising:

a container; and the toner according to claim 1 accommodated in the container.

7. The toner according to claim 1, wherein the amount of the polyester resin is from 75 to 90 parts by mass per 100 parts by mass of the toner.

8. The toner according to claim 1, wherein the binder resin consists of a polyester resin.

9. The toner according to claim 1, wherein the polyester resin is synthesized from an alcohol component and a carboxylic acid component, and the alcohol component comprises an etherified bisphenol.

10. The toner according to claim 1, wherein the fatty acid amide comprises ethylenebis stearamide.

* * * * *